US006664931B1

(12) United States Patent
Nguyen et al.

(10) Patent No.: US 6,664,931 B1
(45) Date of Patent: Dec. 16, 2003

(54) MULTI-FREQUENCY SLOT ANTENNA APPARATUS

(75) Inventors: Henry H. Nguyen, Fort Worth, TX (US); Michael S. Pieper, Fort Worth, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/201,015

(22) Filed: Jul. 23, 2002

(51) Int. Cl.[7] ..... H01Q 13/10
(52) U.S. Cl. ..... 343/767; 343/700 MS
(58) Field of Search ..... 343/767, 700 MS, 343/702, 768, 769, 770, 846

(56) References Cited

U.S. PATENT DOCUMENTS

| | | | | |
|---|---|---|---|---|
| 4,864,314 A | | 9/1989 | Bond | 343/700 MS |
| 5,337,065 A | | 8/1994 | Bonnet et al. | 343/767 |
| 5,446,471 A | | 8/1995 | Chung et al. | 343/770 |
| 5,489,913 A | | 2/1996 | Raguenet et al. | 343/767 |
| 5,943,020 A | | 8/1999 | Liebendoerfer et al. | 343/702 |
| 5,966,101 A | | 10/1999 | Haub et al. | 343/767 |
| 5,977,916 A | | 11/1999 | Vannatta et al. | 343/702 |
| 6,043,786 A | | 3/2000 | Vannatta et al. | 343/770 |
| 6,133,879 A | | 10/2000 | Grangeat et al. | 343/700 MS |
| 6,184,833 B1 | | 2/2001 | Tran | 343/700 MS |
| 6,252,552 B1 | * | 6/2001 | Tarvas et al. | 343/700 MS |
| 6,307,512 B1 | * | 10/2001 | Geeraert | 343/702 |
| 6,407,715 B1 | * | 6/2002 | Chen | 343/767 |
| 6,515,630 B2 | * | 2/2003 | Honda | 343/702 |
| 6,606,071 B2 | * | 8/2003 | Cheng et al. | 343/767 |

* cited by examiner

*Primary Examiner*—James Clinger
(74) *Attorney, Agent, or Firm*—Brian M. Mancini

(57) ABSTRACT

A multi-frequency antenna apparatus includes an open-ended slot antenna (20) operable at high frequencies, cascaded in series with a antenna element (22) operable at low frequencies, results in two distinct antennas fed by a single excitation port (33). A U-shaped conductive strip (21) defining the slot antenna (20) has a ground connection (37) at one end near the open-ended side of the slot antenna (20) and a virtual feed point (30) on the other end coupled to the antenna element (22). The electrical length from the ground connection (37) to the feed point is about ¼ of a wavelength of the first frequency creating a virtual open at the feed point (30).

20 Claims, 3 Drawing Sheets

— PRIOR ART —

MULTI-FREQUENCY SLOT ANTENNA APPARATUS

CROSS REFERENCE TO RELATED APPLICATIONS

This application is related to U.S. patent application, Ser. No. 9/408,672 by inventors Nguyen, Kwan and Pieper. The related application is assigned to the assignee of the present application, and are hereby incorporated herein in its entirety by this reference thereto.

FIELD OF THE INVENTION

This invention relates generally to antennas, and more particularly to multi-frequency antennas including a slot antenna.

BACKGROUND OF THE INVENTION

Wireless communications technology today requires cellular radiotelephone products that have the capability of operating in multiple frequency bands. The normal operating frequency bands, in the United States for example, are analog, Code Division Multiple Access (CDMA) or Time Division Multiple Access (TDMA) at 800 MHz, Global Positioning System (GPS) at 1500 MHz, Personal Communication System (PCS) at 1900 MHz and Bluetooth™ at 2400 MHz. Whereas in Europe, the normal operating frequency bands are Global System for Mobile Communications (GSM) at 900 MHz, GPS at 1500 MHz, Digital Communication System (DCS) at 1800 MHz and Bluetooth™ at 2400 MHz. The capability to operate on these multiple frequency bands requires an antenna structure able to handle all these frequencies.

External antenna structures, such as retractable and fixed "stubby" antennas have been used with multiple antenna elements to cover the frequency bands of interest. However, these antennas, by their very nature of extending outside of the radiotelephone and of having a fragile construction, are prone to damage. In particular, as the size of radiotelephones shrink, users are more likely to place the phone in pockets or purses where they are subject to jostling and flexing forces that can damage the antenna. Moreover, retractable antennas are less efficient in some frequency bands when retracted, and users are not likely to always extend the antenna in use since this requires extra effort. Further, marketing studies also reveal that users today prefer internal antennas to external antennas.

The trend is for radiotelephones to incorporate fixed antennas contained internally within the radiotelephone. However, this typically increases the size of the radio telephone to accommodate the antenna structure, and it is difficult to maintain antenna efficiency, since the antenna element are now placed in proximity to other conductive components in the radiotelephone. Moreover, the antenna is more susceptible to interference from these same conductive components, further impairing efficiency, particularly in the low frequency bands.

Slot and microstrip transmission line antennas can be used in high frequency applications and have a very low profile. However, due to size constraints, these antennas can only operate in one single frequency band. Slot antennas can be implemented with cutout in a metal surface. Prior art resonant slot antenna geometries include a half wavelength ($\lambda/2$) full slot antenna where both ends of the slot are closed, and the length of the slot is a half wavelength (about 80 mm at 1800/1900 MHz, which is quite long and not practical for cellular phone). Another type of slot antenna is a one-quarter wavelength ($\lambda/4$) open-end slot antenna 10 as shown in prior art FIG. 1. For a $\lambda/4$ slot antenna 10, the length 12 of the slot 14 is a quarter wavelength with one end of the slot 14 closed while the other end is open. The slot 14 is excited differentially by energy coupled from an excitation port providing a positive charge 13 and a negative charge 15 near the closed end of the slot 14 and perpendicular to the slot as shown. The excitation port is typically provided by a microstrip line embedded under the slot. A conductive ground plane 16 surrounds the slot 14. More than one slot antenna can be used in a radiotelephone to obtain radiation in multiple frequency bands. However, separate antennas require separate excitation ports and individual electronic tuning mechanisms, which increases size and cost.

Therefore, there is a need for a small size and low cost internal antenna apparatus with and multi-band frequency radiation capability. Another desired advantage would be to provide performance comparable to external multi-band antennas. It would also be of benefit to provide this antenna apparatus driven by a single excitation port.

DETAILED DESCRIPTION OF THE PREFERRED EMBODIMENTS

Figure 1:
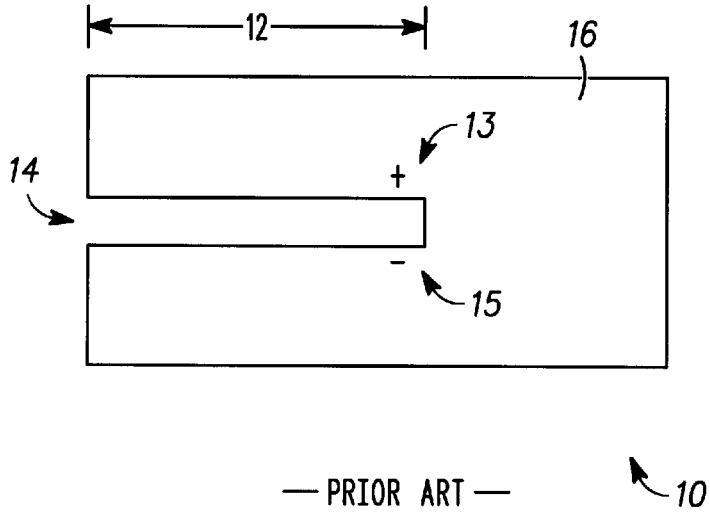
FIG. 1 shows a top plan view of a prior art quarter-wavelength slot antenna.

The present invention provides an internal antenna apparatus with multi-band frequency radiation capability. In particular, a coil antenna is coupled to, and excited by, an open-end slot antenna on a common substrate to cover two distinct frequency bands. The structure described in the present invention provides a compact, low-profile antenna apparatus that can be mounted internally in a radiotelephone with performance comparable to external multi-band antennas. Moreover, the configuration of the open-end slot antenna driving the coil antenna allows this antenna apparatus to be driven by a single excitation port.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. As defined in the invention, a radiotelephone is a portable or mobile communication device that communicates information to a base station using electromagnetic waves in the radio frequency range.

The concept of the present invention can be advantageously used on any electronic product requiring the transceiving of RF signals. Preferably, the radiotelephone portion of the communication device is a cellular radiotelephone adapted for personal communication, but may also be a pager, cordless radiotelephone, or a personal communication service (PCS) radiotelephone. The radiotelephone portion may be constructed in accordance with an analog communication standard or a digital communication standard. The radiotelephone portion generally includes a radio frequency (RF) transmitter, a RF receiver, a controller, an antenna, a battery, a duplex filter, a frequency synthesizer, a signal processor, and a user interface including at least one of a keypad, display, control switches, and a microphone. The radiotelephone portion can also include a paging receiver. The electronics incorporated into a cellular phone, two-way radio or selective radio receiver, such as a pager, are well known in the art, and can be incorporated into the communication device of the present invention.

Figure 2:
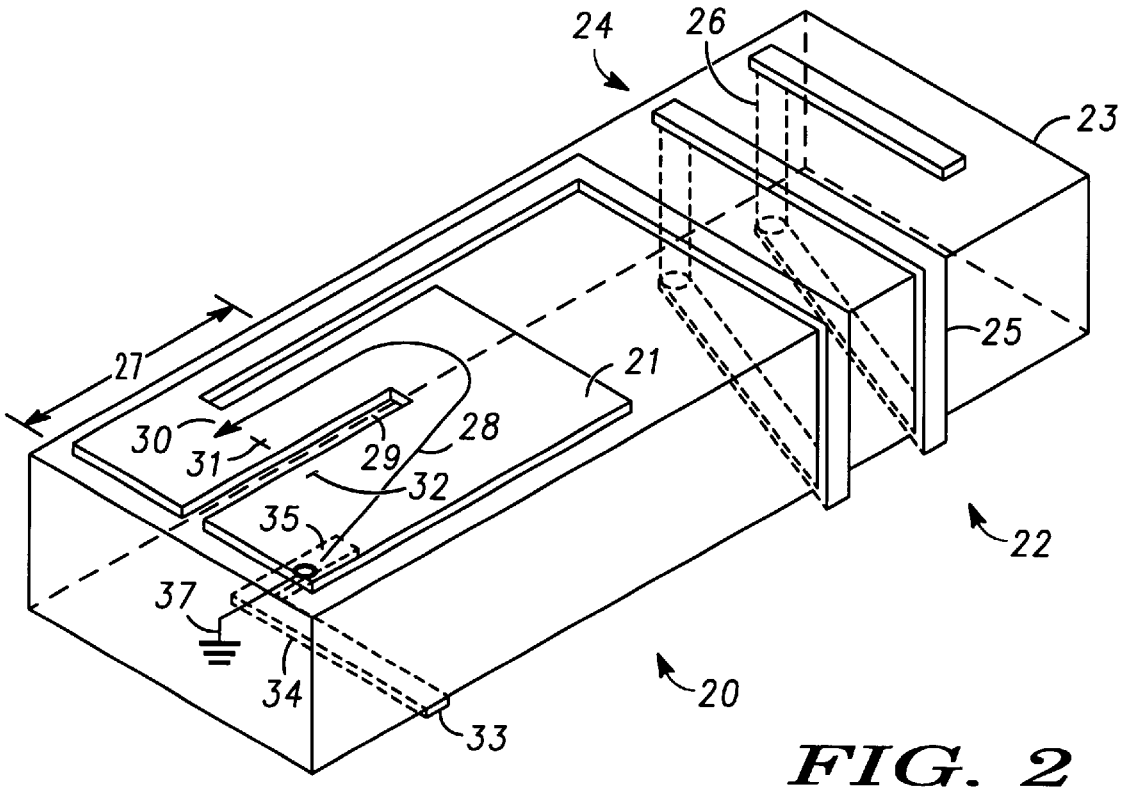
FIG. 2 shows a perspective view of the antenna apparatus of the present invention according to a first preferred embodiment.
Figure 3:
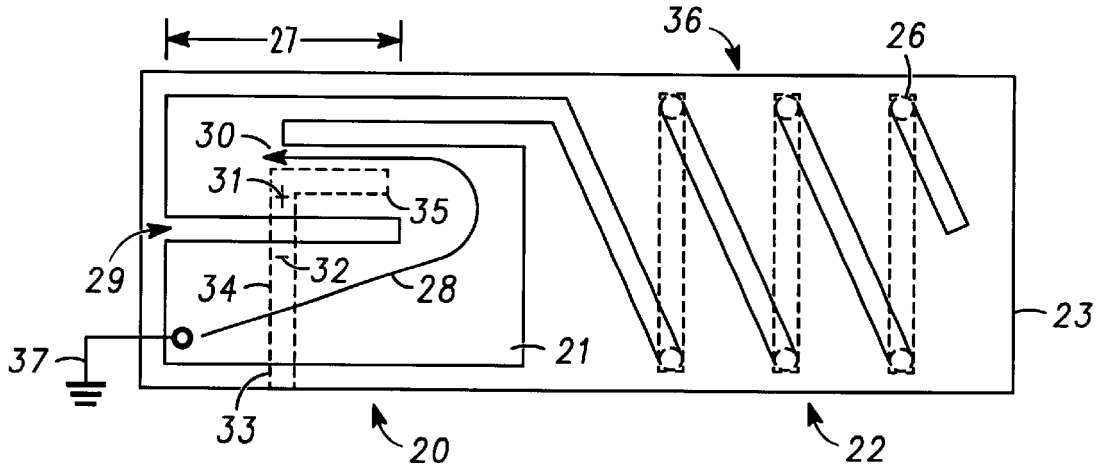
FIG. 3 shows a top plan view of the antenna apparatus of the present invention according to an alternate first preferred embodiment

FIGS. 2 and 3 show an antenna apparatus operable at a first frequency (high frequency band) and a second frequency (low frequency band), in accordance with the present invention. An open-ended slot antenna 20 resonant at the first frequency is connected to an antenna element 22 resonant at the second frequency, cascaded in series. The slot antenna 20 feeds the antenna element 22. Preferably, a portion 24 of the antenna element is arranged in a coil configuration. This is done to reduce the overall length of the antenna structure. However, it should be recognized that the antenna element could also be a straight wire or other arrangement. The slot antenna can also be close-ended on both ends, but this increases the size of the antenna structure. It should be recognized that the thickness of the dielectric as shown is exaggerated to reduce visual clutter.

In particular, a conductive strip 21, a quarter-wavelength long at the first frequency and folded in a U-shape, is disposed on a first portion of a dielectric material 23 and a slot 29 is implemented in the conductive strip 21 to define an open-ended slot antenna 20. The dielectric substrate is rectangular having two long sides and two short sides and opposing top and bottom major surfaces. The U-shaped conductive strip is disposed on the top surface of the dielectric substrate 23. The U-shaped conductive strip includes two side members defining each leg of the U-shape, each about one-eighth the predetermined wavelength in length, and an end member connecting the legs or side-members to complete the U-shape. The side and end members define a substantially rectangular slot 29 extending substantially parallel to the long sides. The slot 29 is closed at a first end (closed end) by the end member, and open at a second end (open end). The antenna further comprises a microstrip feed line 33 attached to the bottom surface of the dielectric substrate for electromagnetically coupling an RF signal between the antenna and an RF device, such as a radiotelephone for example. The microstrip feed line extends across and perpendicular to the slot proximate the second end of the slot, and further extending across a portion of the two side members. A ground point 37 is electrically coupled to a first one of the two side members of the U-shaped conductive strip 21 and positioned proximate the second end of the slot 29.

The length, width and location of the slot affects the operating frequency band achieved. The slot antenna 20 is operable at the first frequency, and has an electrical length 27 of about ⅛ of a wavelength of the first frequency. The conductive strip 21 has a ground connection 37 at one end near the open-ended side of the slot antenna 20, and the antenna element 22 is connected to the opposite end of the conductive strip 21 at a virtual feed point 30. The electrical length 28 from the ground connection 37 to the virtual feed point 30 is about ¼ wavelength at the first frequency. This quarter-wavelength conductive strip serves two significant purposes at the first frequency: a) maximizing the potential difference across the slot 29 at the open-end to achieve maximum radiation from the slot antenna 20, and b) creating an open circuit at the virtual feed point 30 such that the addition of the antenna element 22 at the virtual feed point 30 will not electrically affect the slot antenna 20. A virtual feed point can also be used for a closed-ended slot antenna. along the same principles.

The antenna element 22 is disposed on a second portion of the dielectric material 23, and is operable at the second frequency. The coil portion 24 can include one or both of: a) a conductive strip 25 that is wrapped around the sides of the second portion of the dielectric material 23 (as shown in FIG. 2), or b) two sets of substantially parallel conductive strips disposed on opposing surfaces of the second portion of the dielectric material 23 and connected together through the dielectric material by vias 26 to form a coil winding (as shown in FIG. 3). However, it is envisioned that either one or the other technique would be used in practice. It is preferred that all vias are used inasmuch as this is more easily accomplished in the manufacture of the antenna structure. For example, vias can be formed by plating through-holes in the dielectric sheets after sintering, or filling with conductive materials such as conductive cement or epoxy.

The present invention includes a single excitation port 33 and a microstrip feed-line portion 34 disposed on the dielectric material 23, below and perpendicular to the slot 29. The single excitation port is electromagnetically coupled to both the slot antenna 20 and the antenna element 22. An RF signal injected into the excitation port 33 propagates along the microstrip feed-line 34, and electromagnetically couples to the slot 29, producing different potentials across the slot as represented by a positive charge 31 and a negative charge 32. Consequently, electric fields are established and distributed exponentially decreasing along the slot 29 with maximum amplitude at the open-end and substantially zero amplitude at the closed-end. The single excitation port serves to feed both the slot antenna and antenna element, which is cascaded with the conductive strip defining the slot antenna.

The potential difference across the slot 29 is further maximized by the fact that the electrical length 28 of the conductive strip 21 is about a quarter-wavelength at the first frequency, producing effective radiation from the slot antenna. This differential potential induces RF currents flowing on the conductive strip 21. Maximum current is at the ground connection end and minimum current is at the virtual feed point 30, i.e. a virtual open circuit. The virtual open circuit provides substantially no electrical connection with the coil antenna element 22 at the slot resonant frequency.

At the second frequency, which is lower than the first frequency, the conductive strip 21 is no longer a quarter-wavelength long but rather a short distance from the ground connection end. Relatively strong current is present at the virtual feed point 30 and effectively becomes the current source to drive the antenna element 22. The electrical length of the antenna element 22 is optimized (by adjusting the number of turns for example) to achieve resonance at the second frequency. Note that radiation from the slot 29 is minimum at the second frequency since there is small difference in the potentials across the slot. Also note that the conductive strip 21 becomes part of the antenna element 22, contributed to the electrical length of this antenna at the second frequency. Maximum currents are at the ground connection end and somewhere in the middle of the coil depend on its length, the radiotelephone structure and surrounding environments. As a result, the single excitation port 33 feeds both the slot antenna 20 and the coil antenna 22. In addition, at some frequencies in between the first and the second frequencies, radiations from the slot and the coil antennas add constructively, producing multi-band operations.

Preferably, the microstrip line includes a tuning portion 35 extending parallel to the long axis of the slot 29 of the slot antenna 20 to parasitically load the slot. The parallel tuning portion 35 of the microstrip transmission line is used to capacitively or inductively load the slot at frequencies to change the operational band characteristics of the antenna.

In general, the overall length and width of the invented antenna are limited by the radiotelephone structure and form factor. The length 28 of the U-shape conductive strip 21 is preferably a quarter-wavelength long at the slot resonant frequency. The accumulated length (or equivalently the number of turns) of the coil antenna determines the second resonant frequency. The parameters remaining for tuning to achieve optimum efficiency, bandwidth and input impedance are: a) the width of the slot 29, b) the distance from the microstrip feed-line portion 34 to the slot closed-end, c) the extended parallel portion 35 of the microstrip feed-line, and d) the material properties such as dielectric constant, loss tangent, and dielectric thickness. These parameters can be prioritized as follows: parameters a) and b) are the most sensitive tuning parameters for achieving bandwidth and impedance; parameter c) is for fine-tuning, and parameter d) has the least impact. In practice, there are no specific rules for tuning electrically small antennas mounting in radiotelephones since these antennas are operating in a continuously changing environments (laying on the table, holding in hands next to head, being kept in purse or pocket, etc.) as contrary to electrically large antennas mounting in a fixed position (on top of a tower or roof). Antenna behaviors change drastically when covered by hands or held next to head as in the talking position. Therefore, it should be recognized that antennas cannot be tuned to satisfy all positions.

In practice, the slot 29 shown in this drawing has a width of approximately 2 mm and a length of 15 mm. The width of the conductive strip 21 is 4 mm, uniformly. The microstrip feed-line (portions 34 and 35) is 1.5 mm wide, and position about 9 mm from the closed-end of the slot. Tuning portion 35 of the microstrip feed-line is tunable, typically 12 mm long. Since the feed-line is short, its width is not sensitive to the antenna performance. Again, the length (or the number of turns) of the coil antenna 22 is adjusted for resonance at the low frequency band (the second frequency). The overall dimensions of the invented antenna are 33 mm long and 10 mm wide. Note that the above given dimensions are for reference. Depending on the phone structure and form-factor, these dimensions can be changed accordingly to improve performances. The dielectric used in the present invention is RO3003 material, which has a dielectric constant of 3.0, 0.5 mm thick and 1 oz copper. Choosing higher dielectric constant material will reduce the physical size of the antenna but increase the loss.

The open-ended slot antenna is configured to operate at the higher frequency bands including GPS (1500 MHz), DCS (1800 MHz), PCS (1900 MHz) and Bluetooth™ (2400 MHz). The coil antenna is configured to achieve radiation at the lower frequency bands including analog, CDMA or TDMA (800 MHz) or GSM (900 MHz). In addition, although the drawings show coils with windings having only a few turns, as many turns as needed can be easily implemented in the present invention. Also, the coil can be replaced by microstrip meander-line at the expense of the size.

Figure 4:
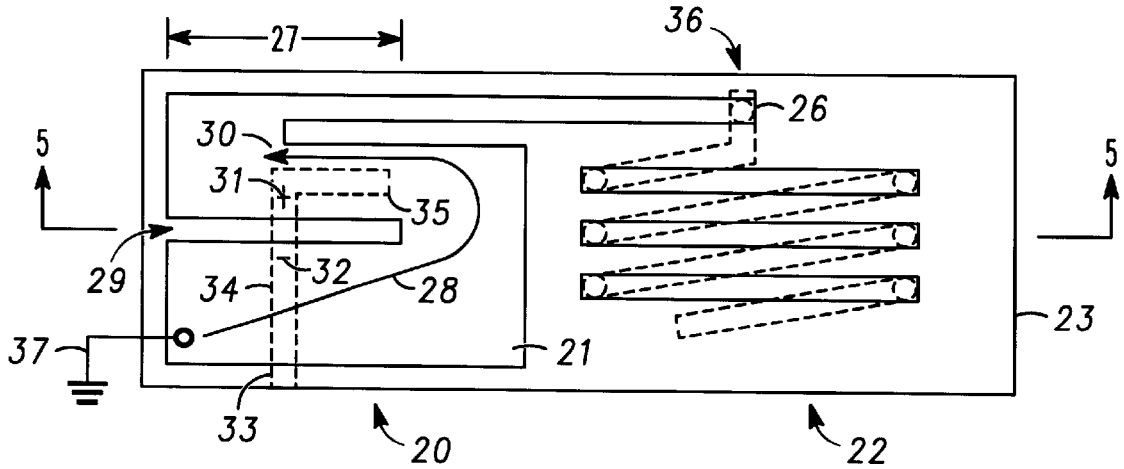
FIG. 4 shows a top plan view of the antenna apparatus of the present invention according to a second preferred embodiment.
Figure 5:
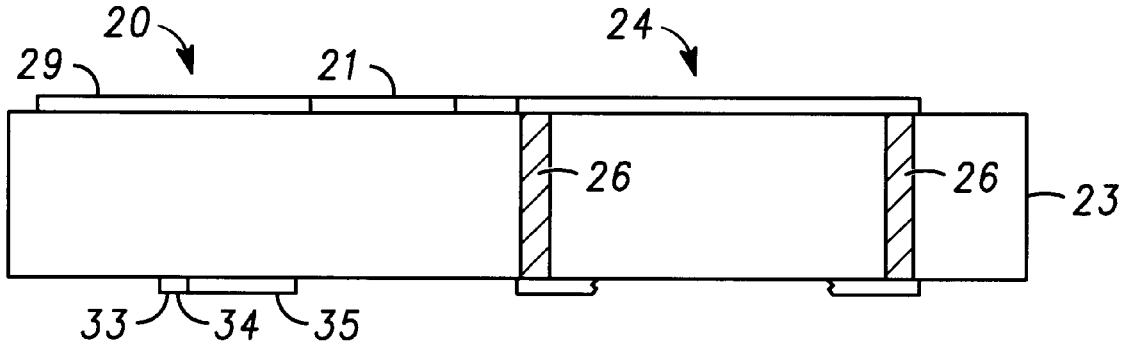
FIG. 5 shows a cross-sectional view of the antenna apparatus of FIG. 4.

FIG. 4 shows a second preferred embodiment of the present invention. In this embodiment, the slot antenna 20 is identical to that of FIGS. 2 and 3, and better demonstrates that relative positions of the microstrip feed-line 33 and the slot 29. In particular, the parallel portion 35 of the microstrip feed-line 33 is located alongside the slot 29 but not underlying it. The slot antenna 20 operates identically to that of FIGS. 2 and 3. However, the coil portion 36 of the antenna element 22 is oriented at ninety-degrees from that shown in FIGS. 2 and 3. This orientation gives the option for further mitigation of any cross coupling between the slot antenna 20 and the antenna element 22. It should be recognized that this orientation takes advantage of the use of vias 26, since wraparound conductive traces cannot be used on one side of the coil. FIG. 5 gives a cross-sectional side view of the antenna apparatus of FIG. 4 to show a clearer view of the vias 26.

Other changes to the present invention can be made such as adding additional conductors disposed on the bottom surface of the dielectric material, with the additional conductors being coupled across the slot to cause the antenna to be radiant at more frequency bands. However, multiple conductor configurations must take into account the interactions between the individual conductors as well as further possible excitation driven ports. In addition, the microstrip feed-line can be located closer to the closed-end of the slot with the parallel portion 35 for tuning directed towards the open-end of the slot. Along these same lines, the microstrip feed-line portions 34 and 35 can be reshaped to form a C-section or a T-section instead of an L-section as shown, as long as at least one part of the feed-line extended across the slot, and the tuning portion extends at least partially parallel to the long axis of the slot. The microstrip feed-line can have other configurations, such as a curve, however the L-shape is preferred to reduce the needed surface area for the antenna. Forming the shape of the microstrip feed-line to a "L", "C", or "T" section, or any other shape is effectively adding capacitive and/or inductive shunt components to achieve the desired impedances without adding external matching network. Further, the antenna apparatus can be configured such that the second radiant frequency band can be either higher or lower than the first radiant frequency band. Although, size constraints limit the preferred embodiment to have the first (slot) frequency be higher than the second (coil) frequency.

In the examples shown above, a multi-band antenna apparatus is shown with two very different types of antenna elements driven by a single excitation port, yet the two elements radiate at different frequency bands. Test results have shown that the antenna apparatus of the present invention provide similar radiation efficiency as an extended external antenna, and better efficiency than a "stubby" antenna. This is provided at a low cost and is implemented in a convenient form factor being located completely internal to a radiotelephone.

While specific components and functions of the multi-band slot antenna are described above, fewer or additional functions could be employed by one skilled in the art within the broad scope of the present invention. The invention should be limited only by the appended claims.

What is claimed is:

1. An antenna apparatus operable at a first frequency and a second frequency, the antenna apparatus comprising:

a dielectric material;

a slot antenna defined a conductive strip disposed on a top surface of a first portion of the dielectric material to form a substantially rectangular slot, the slot antenna being operable at a first frequency with the slot having an electrical length of about ⅛ of a wavelength of the first frequency; and an antenna element disposed on a second portion of the dielectric material, the antenna element is operable at a second frequency; and the conductive strip having a ground connection at one end of the slot antenna and near an opposite end of the conductive strip having a feed point coupled to the antenna element, wherein the electrical length from the ground connection to the feed point is about ¼ of a wavelength of the first frequency.

2. An antenna apparatus according to claim 1, wherein a portion of the antenna element is arranged in a coil configuration.

3. An antenna apparatus according to claim 1, wherein the coil configuration consists of a conductive strip wrapped around the second portion of the dielectric material.

4. An antenna apparatus according to claim 1, wherein the coil configuration consists of two sets of conductive strips disposed on opposing surfaces of the second portion of the dielectric material and connected together through the dielectric material by vias to form a coil winding.

5. An antenna apparatus according to claim 1, further comprising a microstrip feed-line disposed on a bottom surface of the dielectric material, opposing and below the slot antenna and being perpendicular to a long axis thereof.

6. An antenna apparatus according to claim 5, wherein the microstrip feed-line couples energy to the slot antenna near the open-end thereof.

7. An antenna apparatus according to claim 5, wherein the microstrip feed-line includes a tuning portion extending parallel to the long axis of the slot antenna.

8. An antenna apparatus operable at a first frequency and a second frequency, the antenna apparatus comprising:

a dielectric material;

an open-ended slot antenna defined by a U-shaped conductive strip disposed on a top surface of a first portion of a dielectric material to form a substantially rectangular slot, the slot antenna being operable at a first frequency with the slot having an electrical length of about ⅛ of a wavelength of the first frequency;

an antenna element disposed on a second portion of the dielectric material, the antenna element is operable at a second frequency, and the conductive strip having a ground connection at one end and near an opposite end of the conductive strip having a feed point coupled to the antenna element, wherein the electrical length from the ground connection to the feed point is about ¼ of a wavelength of the first frequency, the ground connection and feed point being located near an open-end of the slot antenna; and an excitation port electromagnetically coupled to both the slot antenna and the antenna element.

9. An antenna apparatus according to claim 8, wherein a portion of the antenna element is arranged in a coil configuration.

10. An antenna apparatus according to claim 8, wherein the coil configuration consists of a conductive strip wrapped around the second portion of the dielectric material.

11. An antenna apparatus according to claim 8, wherein the coil configuration consists of two sets of conductive strips disposed on opposing surfaces of the second portion of the dielectric material and connected together through the dielectric material by vias to form a coil winding.

12. An antenna apparatus according to claim 8, further comprising a microstrip feed-line disposed on a bottom surface of the dielectric material, opposing and crossing below the slot antenna and being perpendicular to a long axis thereof.

13. An antenna apparatus according to claim 12, wherein the microstrip feed-line couples energy to the slot antenna near the open-end thereof.

14. An antenna apparatus according to claim 12, wherein the microstrip feed-line includes a tuning portion extending at least partially parallel to the long axis of the slot antenna, the microstrip feed-line having a shape selected from one of the group of a "L" shape, a "C" shape, and a "T" shape.

15. A multi-band radiotelephone including an antenna apparatus operable at a first frequency and a second frequency, the antenna apparatus comprising:

a dielectric material;

an open-ended slot antenna defined by a U-shaped conductive strip disposed on a top surface of a first portion of a dielectric material to form a substantially rectangular slot, the slot antenna being operable at a first frequency with the slot having an electrical length of about ⅛ of a wavelength of the first frequency;

a coil antenna element disposed on a second portion of the dielectric material, the antenna element is operable at a second frequency, and the conductive strip having a ground connection at one end and near an opposite end of the conductive strip having a feed point coupled to the antenna element, wherein the electrical length from the ground connection to the feed point is about ¼ of a wavelength of the first frequency, the ground connection and feed point being located near an open-end of the slot antenna; and an excitation port electromagnetically coupled to both the open-ended slot antenna and the coil antenna element.

16. An antenna apparatus according to claim 15, wherein the coil configuration consists of two sets of conductive strips disposed on opposing surfaces of the second portion of the dielectric material and connected together through the dielectric material by vias to form a coil winding.

17. An antenna apparatus according to claim 15, wherein the excitation port includes a microstrip feed-line disposed on a bottom surface of the dielectric material, opposing and below the slot antenna and perpendicular to a long axis thereof.

18. An antenna apparatus according to claim 17, wherein the microstrip feed-line couples energy to the slot antenna near the open-end thereof.

19. An antenna apparatus according to claim 17, wherein the microstrip feed-line includes a tuning portion extending at least partially parallel to the long axis of the slot antenna.

20. An antenna apparatus according to claim 17, further comprising additional conductors disposed on the bottom surface of the dielectric material, the additional conductors being coupled across the slot, thereby causing the antenna to be radiant at more than one frequency band.

* * * * *